US010092810B2

(12) United States Patent
Sheppard et al.

(10) Patent No.: US 10,092,810 B2
(45) Date of Patent: Oct. 9, 2018

(54) GOLF PUTTING TRAINING AID

(71) Applicants: Mark Sheppard, Roseville, CA (US); Lynda Timbers, Roseville, CA (US)

(72) Inventors: Mark Sheppard, Roseville, CA (US); Lynda Timbers, Roseville, CA (US)

( * ) Notice: Subject to any disclaimer, the term of this patent is extended or adjusted under 35 U.S.C. 154(b) by 133 days.

(21) Appl. No.: 14/120,474

(22) Filed: May 23, 2014

(65) Prior Publication Data

US 2015/0335979 A1 Nov. 26, 2015

(51) Int. Cl.

| | |
|---|---|
| ***A63B 57/00*** | (2015.01) |
| ***A63B 69/36*** | (2006.01) |
| ***A63B 67/02*** | (2006.01) |
| *A63B 63/00* | (2006.01) |

(52) U.S. Cl.

CPC ..... *A63B 69/3676* (2013.01); *A63B 67/02* (2013.01); *A63B 63/00* (2013.01)

(58) Field of Classification Search

CPC ..... A01F 12/30; A63H 27/00; B08B 9/093
USPC ..... 473/174; 460/111; 446/61; 134/166 R
See application file for complete search history.

(56) References Cited

U.S. PATENT DOCUMENTS 3,637,196 A * 1/1972 Kaelin ..... B01F 3/0478 210/219
5,465,443 A * 11/1995 Rice ..... E04H 4/1663 15/1.7
5,855,528 A * 1/1999 Aiello ..... A63B 67/14 473/588
6,089,998 A * 7/2000 O'Neal ..... A63B 67/14 473/588
7,473,171 B1 * 1/2009 Schwinn et al. ..... 460/111
7,473,288 B2 * 1/2009 Toyoda ..... C10L 1/1208 55/282.2
8,007,337 B1 * 8/2011 DeMasi, Sr. ..... 446/61
2012/0102902 A1 * 5/2012 Gallagher ..... B01D 46/0021 55/484
2012/0291826 A1 * 11/2012 Arnett ..... 134/166 R

* cited by examiner

*Primary Examiner* — Gene Kim
*Assistant Examiner* — Christopher Glenn
(74) *Attorney, Agent, or Firm* — Mark C Jacobs

(57) ABSTRACT

A golf putting aide, that can be used as part of an independent game using golf equipment, which aide has a large annular platter with a series of evenly spaced spokes thereon on the upper side, and slip impeding means on the underside. Each spoke, is radiused on both side faces thereof, to match the curvature of a golf ball, such that on impact a golf ball will roll down the spoke toward a center opening in the platter rather than ricocheting off at an angle of incidence post impact. The spokes of the preferred embodiment taper inwardly from the rear surface toward the front surface, evenly on both sides of a center line, and taper downwardly along the top surface from the rear surface forwardly to the front. The device may be used at home on grass, at miniature golf locations or on a golf course hole with permission.

15 Claims, 3 Drawing Sheets

GOLF PUTTING TRAINING AID

FIELD OF INVENTION

This invention pertains to a tool that can be used on or off an actual golf course to aid the putting aspect of a golfer's play.

BACKGROUND OF THE INVENTION

One of the most frustrating aspects of the game of golf, is putting, and missing, and having to putt again, and perhaps again, from closer or further from the golf hole than the initial stroke. Many a male has lost his cool when teaching putting to a student-wife or girlfriend. Many tools have been developed over the years to improve the putter's score by reducing the number of strokes necessary to complete the hole.

Early tools developed were generally U shaped channels that fit partway around a golf hole, and gave the putter a target to aim for. But these could also be detrimental to the putter if the ball hit the device on its outer edge causing the ball to deflect away from the hole. See U.S. Design 155,370 and U.S. Pat. No. 2,459,559, both of R. E. Watkins.

A horseshoe shaped recent device that surrounds the hole is found in the Burkholder U.S. Pat. No. 6,800,034. This device helps get the ball into the cup once the golfer hits the ball. But the device in no way influences the ball movement. Once within the bounds of the Burkholder device, the ball will go into the cup. But is has to get into the confines of the device in the first place to do so. It is also possible, that the shot if too forceful, could skip over the top of the curved wall of the Burkholder device, to again create frustration for the golfer.

Tony Falco created a flexible chain device in his U.S. Pat. No. 6,183,373 that arcs around a hole in the hope that the ball is diverted within the confines of the area defined by the two markers on the ends of the flexible chain, will go into the hole within the area, and not jump over the chain, be the chain plastic or heavy metal.

Yet another device to aid the putter is the folding golf too of Lynch, U.S. Pat. No. 8,192,294. This device resembles a folding carpenter's ruler with a flag at the center of the device to mark the hole.

Other training aid patents include O'Neil, Design 345, 842, Yamaguchie at al, U.S. Pat. No. 5,310,187, a device placed in front of the hole and Potter U.S. Pat. No. 6,923,730 who operates a caliper type device in U.S. Pat. No. 6,923, 730 among a whole bunch of others.

These devices fail to naturally influence the trajectory of the moving ball, and none of the devices have the ability to define a separate game that can be used by young and old alike, or newbie or experienced golfer.

SUMMARY OF THE INVENTION

This device has a flat circular base, with an optional feathered top edge and a series of between 4 and 6 ball guides that steer the moving ball toward a central opening which central opening can be overlaid upon an actual golf hole, or used by itself as a putt receiving aide. The base is thus seen to be an annulus having a series of specifically defined spokes on the upper surface of the base that commence at the outer edge of the base, and terminate at the center opening of the base. The under surface of the base may be smooth, roughened to prevent movement or have a series of short cleat like feet, again to enhance resistance to movement when a golf ball or balls impacts the spokes or rails mounted on the base. Means for hanging or carrying the device may also be incorporated therein.

DESCRIPTION OF THE PREFERRED EMBODIMENT

Figure 1:
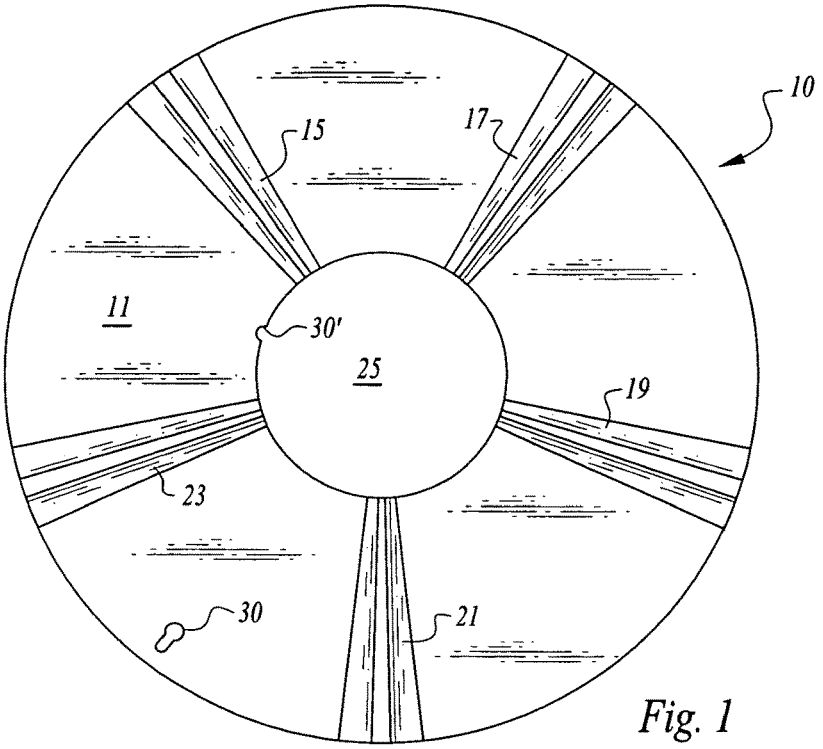
FIG. 1 is a top plan view of the base of this invention
Figure 4:
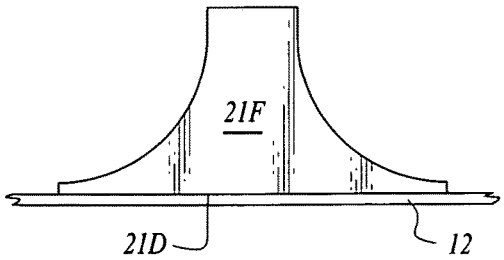
FIG. 4 is an exterior elevational view of one spoke and its surrounding area
Figure 6:
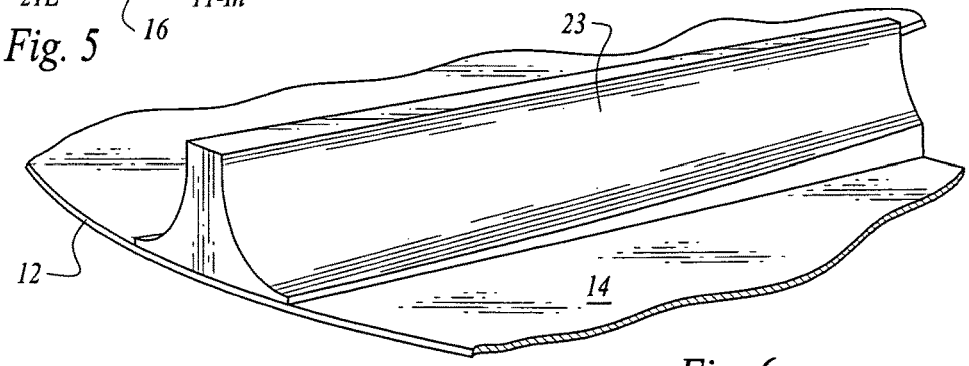
FIG. 6 is a right side perspective view of one spoke of this invention. The left side is a mirror image of the right side of the spoke

FIG. 1 is a top plan view of the device of this invention, 10. The invention 10 has a base 11, with a top surface 14, and a bottom surface 13, as well as an elevation or thickness 12, which elevation is seen in FIGS. 4 and 6. The base, 11, has a series of uniformly spaced spokes or rails, 15, 17, 19, 21, and 23 all of which commence at the outer edge of the preferably rigid base's top surface 14 and radiate inward toward terminate at the central opening 25. The base 11 may be made of sheet metal, high impact rigid plastic or of flexible material such as sheet polyurethane. A keyhole 30 shown between spokes 21 and 23 may be incorporated into the base to hang the device on back when not in use. More about the spokes, is set forth below.

Figure 2:
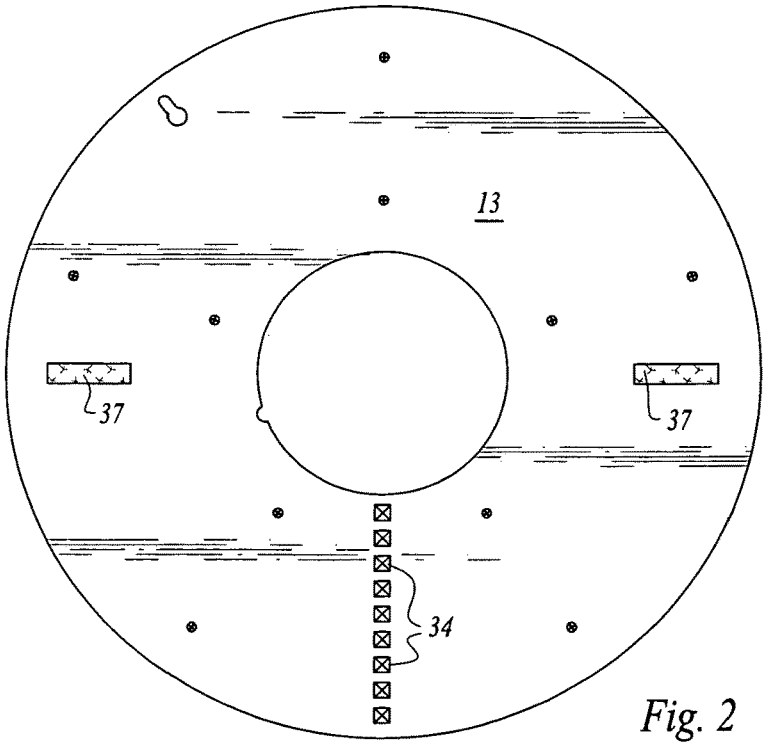
FIG. 2 is a bottom plan view of this device

In FIG. 2 a series, here two are seen of optional male gender hook tabs of hook and loop connectors having an adhesive back (Velcro®) may be applied to add some gripability to the base underside to reduce creep or slippage after ball impact(s) in any of the spokes or rails 15-23.

The overall diameter of the base 11 can vary from about twelve (12) inches to 18 (eighteen) inches, and the central opening can vary from about 6.5 inches to 8 inches, which range is greater that the 6" diameter of a golf hole cup. It is suggested that the diameter of the platter or base 11 be about 12 inches for ease of portability of this putting tool, and about 15 inches in diameter for use in a fixed location such as a person's backyard or on a golf course green.

Again referring to FIG. 2 a series of spaced tiny cleats 34 can be welded onto a metallic sheet base, 11. These cleats 34 may be molded directly into a metal or plastic base; or added by gluing or otherwise attaching them separately to a plywood or metal base. Each cleat may be about ¼" high, again to impede movement, on a grass surface, but not raise the elevation of the device away from laying flat on the low grassy surface of an actual golf hole or the higher grassy area of a pseudo golf hole in one's back yard.

Figure 3:
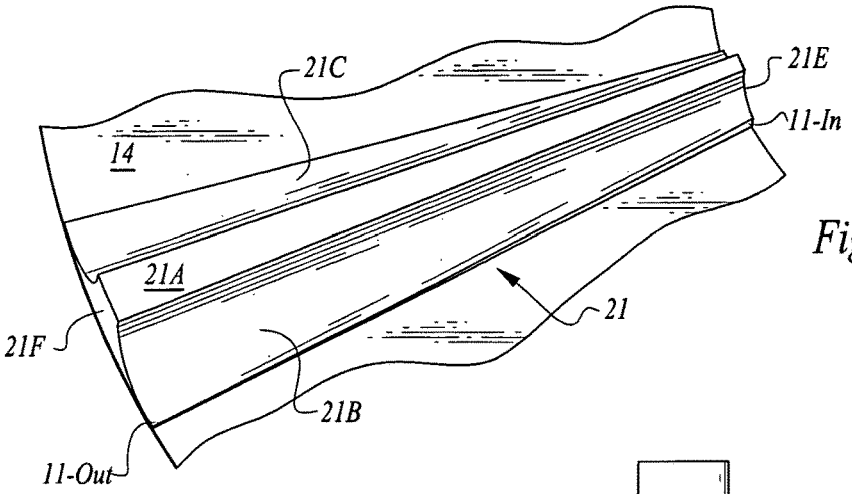
FIG. 3 is a closeup top perspective view of one spoke of this invention

The discussion now moves to FIG. 3 and FIG. 1 and the specifically configured spokes or rails of this invention. While FIG. 1 shows the presence of 5 spokes, the number can be reduced to 3 or increased to about 8 spokes, preferably each evenly spaced from the next adjacent spoke. Spoke 21 seen in FIG. 3, is a 4 sides solid member which has an upper surface 21A, a right side 21B, a left side 21C and a bottom surface 21D seen in FIG. 4. Upper surface 21A has a smaller cross section than the bottom surface 21D at any point along the elevation of the spoke from its interior edge adjacent opening 25 to the outer edge of the platter 11. The inner elevation is designated 21E and outer elevation is 21F. Compare the two termini and it is seen that the outer elevation 21F is wider than the inner elevation 21E Each other spoke or rail, will have a similar set of surfaces as spoke 21 just discussed. Each spoke may have a uniform elevation or as seen in FIG. 3 and elsewhere, for the preferred embodiment, the elevation may decrease from the outer edge of the platform 11-O u to the inner edge thereof 11-In, or restated the elevation decreases from face 21F to face 21E.

The key feature of each spoke of this invention is the radiused inwardly side walls 21B and 21C. The arc of each side wall commences at a radius that matches the periphery of a golf ball, and continues to get smaller, but all the time nests a smaller and smaller portion of the surface of the ball as the ball rolls along the "carved" out area of the side wall of the spoke. At the outside edge, 21D, the height of the channel is above the elevation of the center point of the golf ball. That is the height of the radius channel is greater than the sectional radius of a golf ball.

Figure 5:
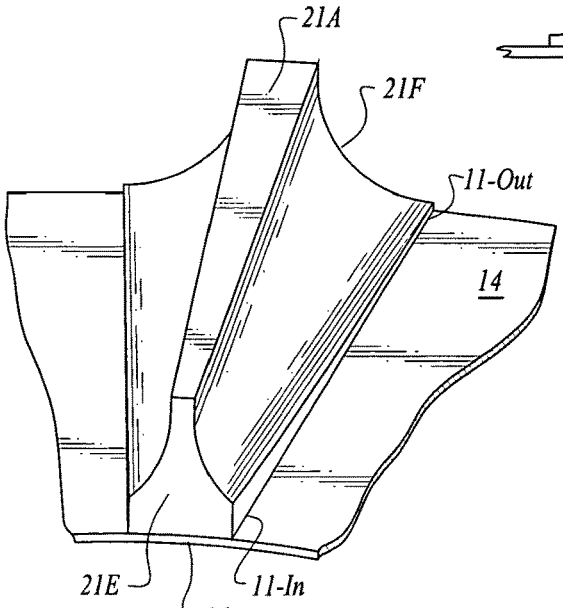
FIG. 5 is an interior top perspective view of one spoke and the surrounding area of this device

The concave curvature of the spoke which extends the full length of the spoke on both side surfaces, by matching the convex curvature of the golf ball tends to guide the ball along the length of the spoke toward the center opening 25, rather than having the ball impact the spoke at an angle of incidence and ricochet off at an angle of reflection. Instead, the ball on impact momentarily nests in the radius and rides along the spoke toward the center opening 25 the invention 10, and hopefully into the golf hole. See the top view of FIG. 3 for decreasing radius size, as well as FIG. 5 which is a top perspective view. Thus it is seen that the overall horizontal width narrows down from the exterior edge of the platform to the front surface of each spoke toward the vertical center line of each spoke and the elevation tapers downwardly also from the outer edge toward the inner edge at the opening 25. This is readily seen in FIG. 6 where both the change in width and elevation can both be seen in the same FIGURE.

FIG. 4 illustrates the exterior face 21F of a spoke and also the relative thickness 16 of the platter 11 can be seen. The thickness can also be seen in FIG. 5.

FIG. 6 is a perspective view that illustrates the placement of several spokes 15,17, and 23 disposed on top surface 14 of the platter 11.

Figure 7:
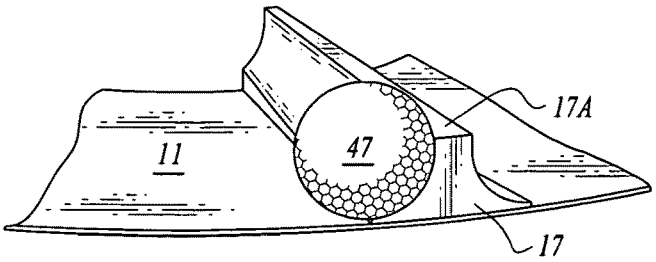
FIG. 7 is at a first moment in time showing a golf ball rolling along a spoke of this invention
Figure 8:
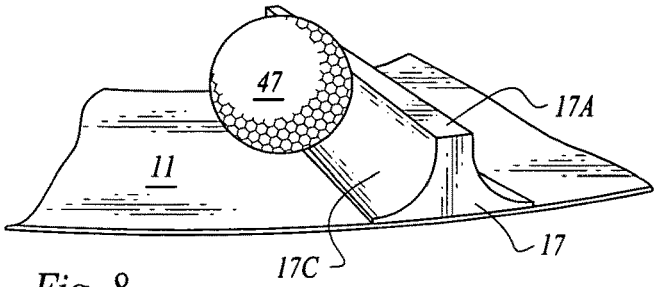
FIG. 8 is a similar view at later moment in time
Figure 9:
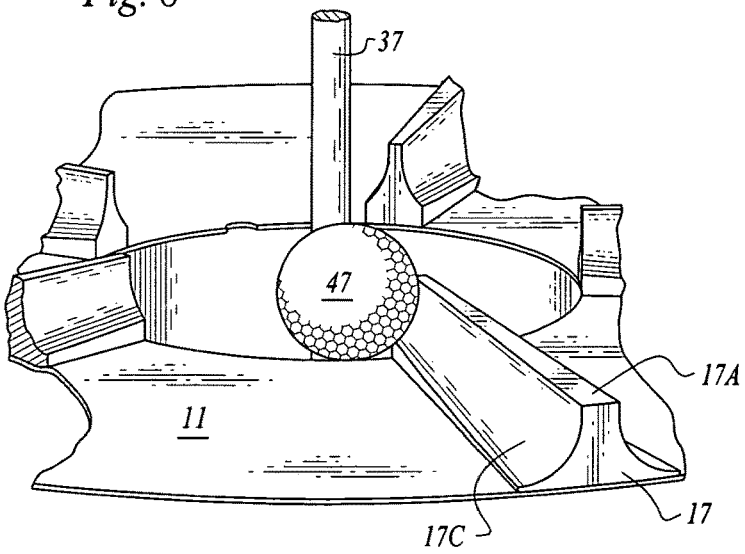
FIG. 9 is a similar view to FIG. 8 at a moment still later in time

FIGS. 7,8, and 9 all illustrate the movement of golf ball 47 along the radiused inwardly channel of a typical spoke, here spoke 17 Note how the upper surface 17A is above the center point of the ball 37 in FIG. 7. As the ball travels in FIG. 8 toward the hole, less of the convex radius of the ball nests within the channel 17C, As the hole approaches the hole in FIG. 9, only a small portion of the ball is rolling along the channel.

Figure 10:
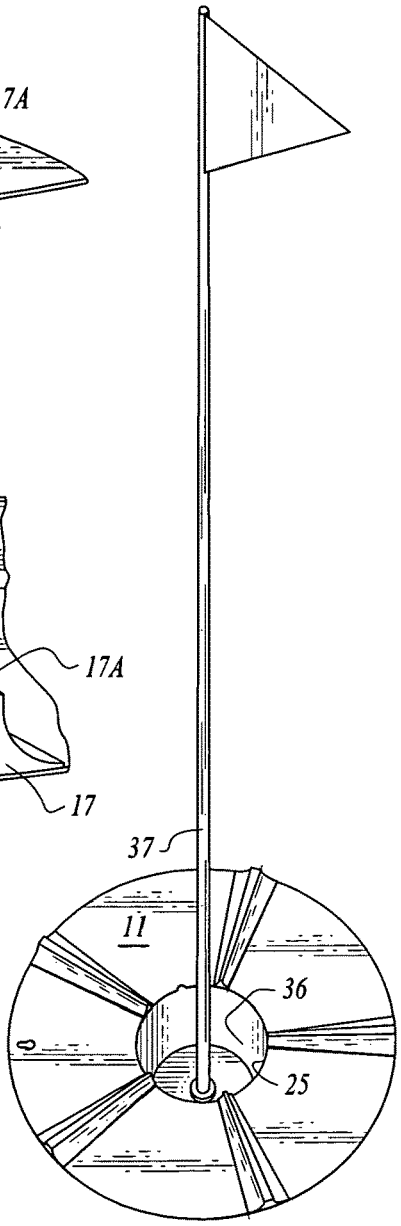
FIG. 10 is a perspective view of this device on the green overlaying the cup on a golf hole.

In FIG. 10, an aerial view, the platter 11 with 5 spokes is seen overlying the hole 36 which is seen within the cutout or central opening 25 of the device. Flag pin 37 is seen disposed within the golf hole as would normally be the case.

This device 10 may be utilized at home in one's yard, at a miniature golf course, especially with kids, to reduce their irritation from poor shooting, and on a standard golf course, all with the idea of making the putting aspect of a game easier or for just creating a new game of just getting the ball in the hole with the minimum of strokes while forgetting about the rules of golf.

It is seen that we have developed a low cost accessory to golf that also serves as a basis for a stand alone new putting game, to be enjoyed by young and old alike.

Since certain changes may be made in the above device without departing from the scope of the invention herein involved, it is intended that all matter contained in the above description and shown in the accompanying drawings, shall be interpreted as illustrative only and not in a limiting sense.

We claim:

1. A device to be used as both a golf putting aide and for use as a tool in a separate golf putting game, said device comprising: an annular flat platter having a top surface and a bottom surface-, said annular platter having a series of uniformly spaced spokes, each of said spokes has a rear and a front and a vertical center line normal to the annular platter, each spoke directed from an outer edge of the platter to a center through opening of the annular platter, each spoke having 2 side surfaces both of which are progressively decreasingly radiused inwardly, wherein each spoke tapers inwardly toward said vertical center line of said spoke from the rear of each spoke toward the front of each said spoke, said opposite side radii being separated by a horizontal top surface of the spoke, said top surface is directed toward the through opening and wherein an overall width of each spoke diminishes from the outer edge of the platter toward the center through opening of the annulus, said center through opening of said annulus being greater than a diameter of a golf course hole, said diameter of said golf course hole is 4.5 inches, whereby when a convex surface of a golf ball impacts the radiused surface of a spoke, the ball rolls along a length of the spoke within the radiused area toward said center opening of the platter, rather than impacting the spoke and then ricocheting off at an angle of reflection.

2. The device of claim 1, wherein an elevation of each spoke decreases from the rear edge of the spoke toward the front of each spoke.

3. The device of claim 1, further including a keyhole slot in the platter for hanging the platter on a nail or hook.

4. The device of claim 2, where there are 5 spokes spaced evenly on the top surface of the platter, each spoke directed from the outer edge of the platter toward the through opening.

5. The device of claim 1, including means to inhibit the slippage of the platter's bottom surface after impact of a golf ball on a spoke.

6. A device for use in reducing the number of strokes of a golfer when putting, when said device is overlaid on a golf course hole, said device comprising an annular flat platter of a thickness of about 0.25 inches, and being between 12 and 15 inches in diameter, with a center through opening of about 6 inches, said device having a series of uniformly spaced spokes, each spoke having two side surfaces, each spoke has a front and a rear and each spoke is progressively decreasingly in width from the outer edge of the platter as the spokes extend to the center through opening of the platter, said spokes being inwardly radiused spokes, each of said spokes has a vertical centerline with a horizontal top surface thereon normal to the annular platter, wherein the radius of said spokes matches a convex curved surface of a golf ball, said radius being on both side surfaces of each spoke.

7. The device of claim 6, wherein the spokes are of uniform elevation along a length thereof.

8. The device of claim 6, wherein the elevation of each spoke decreases uniformly from the outer rear edge of each spoke toward the center opening.

9. The device of claim 1, wherein a vertical elevation of each spoke adjacent the outer edge of the plate is higher than the crossectional diameter of a golf ball.

10. A device to be used as both a golf putting aide and/or used as a tool in a separate golf putting game, said device comprising: a circular annular flat platter having a top side and a bottom side, said annular platter having a series of four to eight uniformly spaced spokes directed from an outer rear edge of the platter to a center through opening of the annulus, each spoke having two side surfaces both of which are radiused inwardly in like manner to match the curvature of a golf ball, and said radii run the full length of both sides of each spoke, wherein each spoke's side tapers inwardly toward a horizontal top surface of said spoke from a rear of each spoke toward a front of said spoke which is adjacent the center opening of the annulus, the center opening of said annulus being about 6.5 inches in diameter, wherein an elevation of each spoke decreases from the rear edge of the spoke toward the front edge of each spoke, wherein the front edge is at the center opening of said platter, and an overall width of each spoke decreases from the outer edge of the platter toward the center through opening of the annulus.

11. The device of claim 10, wherein the platter and the spokes are made of high impact plastic.

12. The device of claim 11, further including cleats on the bottom of the platter and a single key hole slot in the platter for wall mounting said device during non-use.

13. The device of claim 5, including a series of spaced cleats on the bottom of said platter to inhibit slippage from a preset position.

14. In combination, the device of claim 1 and a golf ball for rolling along any of the radii of the said spokes of the device toward a golf hole over which the device is overlaid, said golf ball changing course upon impact with the device and rolling toward the golf hole, rather than ricocheting off at an angle equal to the angle of incidence.

15. In combination, the device of claim 6 and a golf ball for rolling along any of the radii of the spokes of the device toward a golf hole over which the device is overlaid, said golf ball changing course upon impact with the device and rolling toward the golf hole, rather than ricocheting off at an angle equal to the angle of incidence.

* * * * *